US006755250B2

(12) United States Patent
Hall et al.

(10) Patent No.: US 6,755,250 B2
(45) Date of Patent: Jun. 29, 2004

(54) GAS-LIQUID SEPARATOR POSITIONABLE DOWN HOLE IN A WELL BORE

(75) Inventors: Jared C. Hall, Carlsbad, NM (US); James A. Tomlinson, Carlsbad, NM (US); David E. Ellwood, Spring, TX (US)

(73) Assignee: Marathon Oil Company, Findlay, OH (US)

( * ) Notice: Subject to any disclaimer, the term of this patent is extended or adjusted under 35 U.S.C. 154(b) by 0 days.

(21) Appl. No.: 10/222,771

(22) Filed: Aug. 16, 2002

(65) Prior Publication Data

US 2004/0031608 A1 Feb. 19, 2004

(51) Int. Cl.[7] ..... E21B 43/38
(52) U.S. Cl. ..... 166/265; 166/105.5
(58) Field of Search ..... 166/265, 105.5

(56) References Cited

U.S. PATENT DOCUMENTS

| | | | | | |
|---|---|---|---|---|---|
| 1,628,900 | A | * | 5/1927 | Neilsen | 166/105.5 |
| 2,429,043 | A | * | 10/1947 | Barnhart | 166/105.5 |
| 3,128,719 | A | * | 4/1964 | Jongbloed et al. | 166/105.5 |
| 4,531,584 | A | * | 7/1985 | Ward | 166/265 |
| 4,900,433 | A | | 2/1990 | Dean et al. | 210/170 |
| 5,431,228 | A | | 7/1995 | Weingarten et al. | 166/357 |
| 5,474,601 | A | | 12/1995 | Choi | 96/182 |
| 5,482,117 | A | * | 1/1996 | Kolpak et al. | 166/265 |
| 5,992,521 | A | * | 11/1999 | Bergren et al. | 166/265 |
| 6,155,751 | A | | 12/2000 | Lane et al. | 406/61 |
| 6,216,781 | B1 | * | 4/2001 | Knight | 166/105.5 |
| 6,336,504 | B1 | * | 1/2002 | Alhanati et al. | 166/265 |

OTHER PUBLICATIONS

Cambell, John, "New Flowline Technology Provides Higher Production, Lower Operating Costs, Fast Paybacks", *Rocky Mountain Oil Journal*, reprinted from Jun. 14–Jun. 20, 2002 edition.

* cited by examiner

*Primary Examiner*—Hoang Dang
(74) *Attorney, Agent, or Firm*—Jack E. Ebel; Rodney F. Brown

(57) ABSTRACT

A gas-liquid separator positionable down hole in a well bore includes an external tube having an external tube interior and an internal tube having an internal tube interior. The internal tube is positioned in the external tube interior to form an internal annulus defining a gas flowpath and the internal tube interior defines a reduced-gas fluid flowpath. A plate at least partially encircles the external tube to form a curved flow channel, which defines a produced fluid mixture flowpath. A first internal annulus opening is provided in the external tube, which defines a gas inlet port. An internal tube interior opening is provided in the internal tube, which defines a reduced-gas fluid inlet port. A produced fluid mixture is conveyed through the flow channel, which spins the produced fluid mixture about the external tube. At least a portion of a gas in the produced fluid mixture is separated from the liquid in response to spinning, thereby producing a separated free gas which enters the gas flowpath via the gas inlet port and a reduced-gas fluid which enters the reduced-gas fluid flowpath via the reduced gas-fluid inlet port.

35 Claims, 9 Drawing Sheets

134
136
12
26
28
126
132
128
124
14
130
24
122
44
120
60
16
74
56
34
62
10
118
72
60
52
68
58
70
48
54
32
64
22
42
66
30
20
58

78
58
82
88
38
90
42
84
86
76
80
58
10
54
30
16
92
36
72
98
48
14
24
66
62
64
32
96
94
106
112
110
114
104
108
56
52
60
20
46
22
100
102
18
17

148
134
136
140
26
12
146
138
146
28
142
126
128
14
124
24
44
146
16
74
56
146
62
10
118
72
148
70
146
54
32
30
66
142

142
78
38
90
14
76
142
80
144
10
30
148
146
98
16
36
146
62
96
94
32
146
104
114
148
46
18
100
102
17

134
136
12
172
44
14
74
56
150
34
118
60
32
52
72
68
24
26
70
42
62
54
28
16
66
64
172
6
6
58
160
30
62
156
16
156
152
162
14
154
170
168
166
38
160
164
158
158
30
172
162
20
58
22

148
134
136
12
146
14
146
74
56
146
150
118
146
34
146
140
28
148
26
24
16
142
138
62
30
156
160
16
156
152
162
170
14
38
154
150
142
166
168
164
160
158
158
162
22
20

GAS-LIQUID SEPARATOR POSITIONABLE DOWN HOLE IN A WELL BORE

TECHNICAL FIELD

The present invention relates generally to oil recovery, and more particularly to down hole separation of produced fluid in a well bore into gases and liquids.

BACKGROUND OF THE INVENTION

Many oil production wells require artificial lift equipment to raise the produced oil to the surface well head after the oil enters the well bore from an adjacent fluid production zone penetrated by the well bore. However, the oil entering the well bore from the fluid production zone is typically contained within a produced fluid mixture having two phases, a gas phase and a liquid phase. The liquid phase includes the oil as well as water, while the gas phase includes dissolved or otherwise entrained gases and/or free gases. The artificial lift equipment is generally effective for raising the liquids to the surface, but conversely is relatively ineffective when produced fluid mixtures having a high gas content are encountered. Therefore, it is desirable to separate the produced fluid mixture into the gases and liquids before employing the artificial lift equipment to raise the liqulids to the surface.

The present invention recognizes the need for a gas-liquid separator positionable down hole in a well bore which effectively separates a produced fluid mixture into gases and liquids before utilizing artificial lift equipment to raise the liquids to the surface. Accordingly, it is an object of the present invention to provide such a gas-liquid separator and a method of operating the same. More particularly, it is an object of the present invention to provide an essentially static gas-liquid separator for centrifugally separating a produced fluid mixture into gases and liquids, including hydrocarbon liquids, down hole in a well bore before raising the liquids to the surface by means of an artificial lift assembly associated with the gas-liquid separator. These objects and others are accomplished in accordance with the invention described hereafter.

SUMMARY OF THE INVENTION

The present invention is a gas-liquid separator positionable down hole in a well bore. The gas-liquid separator comprises an external tube and an internal tube. The external tube has an external tube interior and an internal tube correspondingly has an internal tube interior. The internal tube is positioned in the external tube interior with the longitudinal axes of the internal and external tubes substantially aligned, thereby forming an internal annulus between the external tube and internal tube, which defines a free gas flowpath. The internal tube interior defines a reduced-gas fluid flowpath. The gas-liquid separator further comprises a plate having a start point and an end point. The plate at least partially encircles the external tube to form a curved flow channel, which defines a produced fluid mixture flowpath. A first internal annulus opening is provided in the external tube beyond the start point of the plate, which defines a free gas inlet port for the free gas flowpath. The external tube preferably has a flared portion positioned at or proximal to the first internal annulus opening which flares outwardly as the flared portion extends away from the start point of the plate. The first internal annulus opening preferably comprises a plurality of flared perforations extending through the flared portion of the external tube.

The internal tube extends from the external tube interior beyond the first internal annulus opening and an internal tube interior opening is provided in the internal tube beyond the start point of the plate, which defines a reduced-gas fluid inlet port for the reduced-gas fluid flowpath. The internal tube interior opening preferably comprises a plurality of inlet perforations.

The gas-liquid separator further comprises a disk and an artificial lift assembly. The disk has a plurality of disk perforations extending through the disk and is positioned above the internal tube interior opening and below the internal annulus opening. The artificial lift assembly is positioned either above or below the plate. A second internal annulus opening is provided above the start point of the plate, which defines a free gas outlet port for the free gas flowpath. The second internal annulus opening preferably comprises a plurality of outlet perforations.

The plate of the liquid gas separator has a number of alternate configurations. In accordance with one configuration, the plate is a spiral plate which has at least one turn about the external tube. In accordance with another configuration, the plate is a first pitched plate which has at least a one-quarter turn about the external tube. A second pitched plate may also be provided which is aligned in parallel or in series with the first pitched plate.

An alternate gas-liquid separator of the present invention comprises the external and internal tubes as recited above and means for spinning a produced fluid mixture about the external tube. The spinning means is essentially static relative to the external tube.

The present invention is also a method for separating a gas from a fluid mixture down hole in a well bore. The method comprises producing a fluid mixture including a gas and a hydrocarbon liquid into a well bore from a point in a fluid production zone. An external tube with an external tube interior is positioned in the well bore and forms an external annulus between the external tube and a well bore face or casing. The fluid mixture is conveyed from the point in the fluid production zone through the external annulus to a flow channel at least partially encircling the external tube. The fluid mixture is then conveyed through the flow channel to spin the fluid mixture about the external tube. A portion of the gas is separated from the hydrocarbon liquid in the fluid mixture in response to spinning the fluid mixture, thereby producing a separated free gas and a reduced-gas fluid. The separated free gas is conveyed through a first opening in the external tube into the external tube interior and upward in the well bore via the external tube interior.

An internal tube having an internal tube interior is preferably positioned within the external tube interior to form an internal annulus in the external tube interior between the external tube and the internal tube and the separated free gas is conveyed upward in the well bore via the internal annulus. The separated free gas is subsequently conveyed through a second opening in the external tube from the external tube interior. The first opening in the external tube is preferably below the point in the fluid production zone and the second opening is preferably above the point in the fluid production zone. The reduced-gas fluid is conveyed through an opening in the internal tube into the internal tube interior and upward in the well bore via the internal tube interior. The second opening is above the first opening in the external tube and the first opening in the external tube is above the opening in the internal tube.

The present invention will be further understood from the drawings and the following detailed description.

DESCRIPTION OF PREFERRED EMBODIMENTS

Figure 1A:
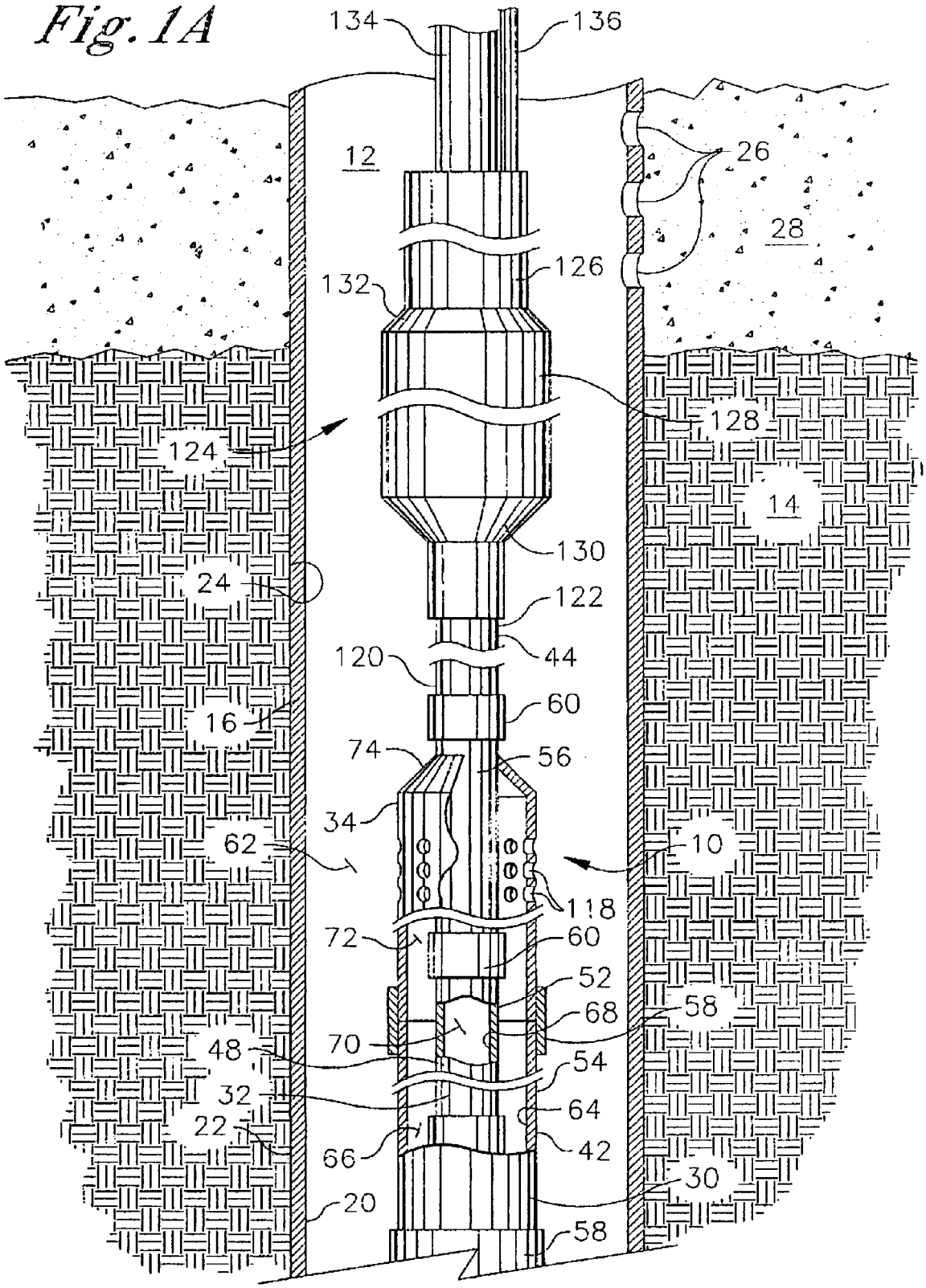
FIGS. 1A and 1B are an elevational view of a gas-liquid separator of the present invention positioned in a cased well bore.
Figure 1B:
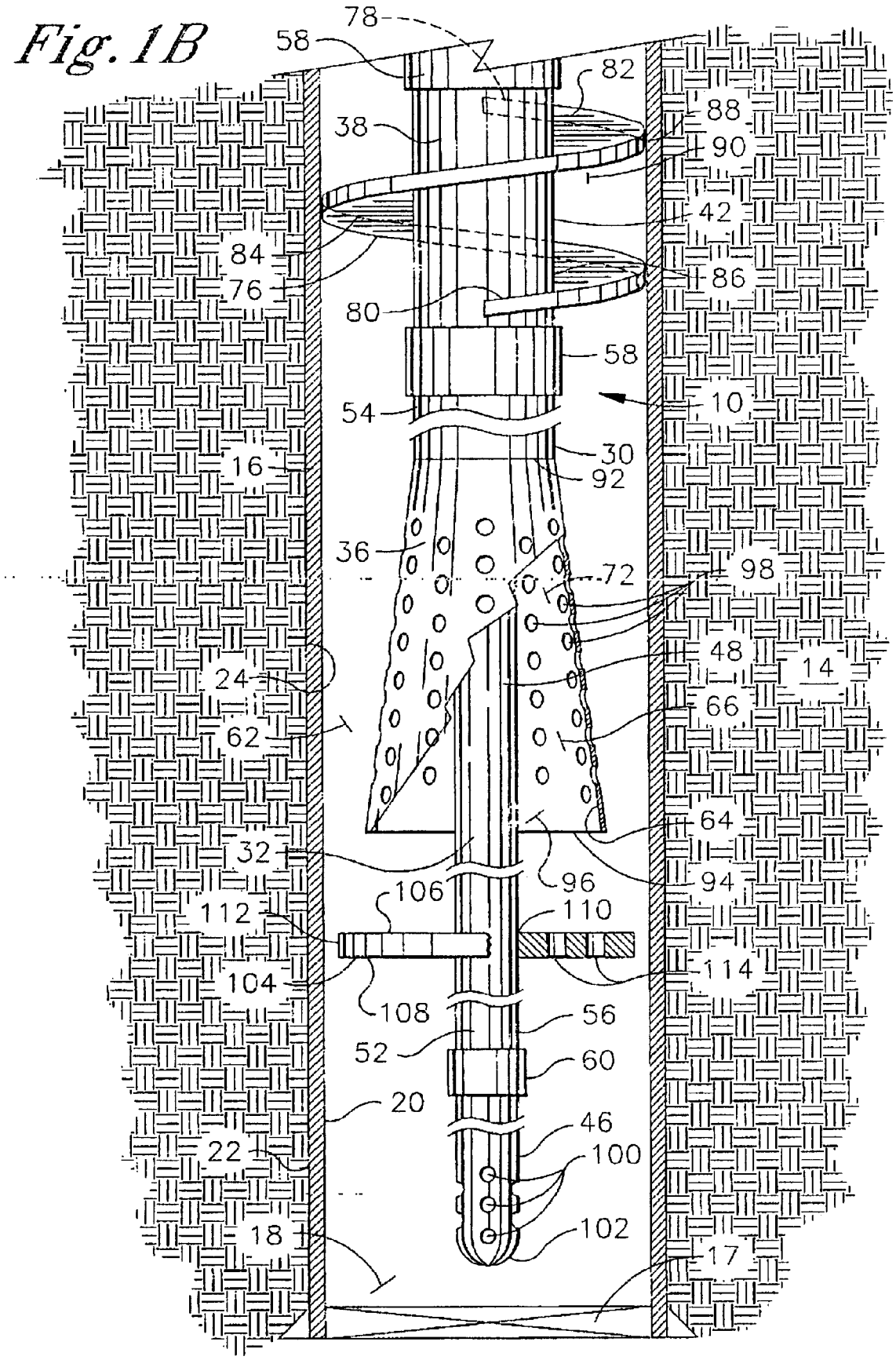

Referring to FIGS. 1A and 1B, a gas-liquid separator of the present invention is shown and generally designated 10. The gas-liquid separator 10 is positioned down hole within a well bore 12, which extends from an earthen surface (not shown) through an earthen formation 14. A "well bore", as defined herein, is the actual bore hole of a well. The well bore 12 is bounded by the walls of the earthen formation 14, through which the well bore 12 extends. The Walls of the earthen formation 14 bounding the well bore 12 are termed the "well bore face".

The gas-liquid separator 10 and the well bore 12 are parallely, and preferably concentrically, aligned with reference: to their respective longitudinal axes. The longitudinal axes of the gas-liquid separator 10 and the well bore 12 are likewise preferably vertically aligned relative to the earthen surface overlying the earthen formation 14. As such, earth's gravitational force is downwardly directed in the well bore 12, thereby exerting a downward force against any fluids residing in the well bore 12. The terms "down" and "up" are used herein with reference to the earthen surface and the earth center, wherein "down" is away from the earthen surface toward the earth center and "up" is toward the earthen surface away from the earth center.

Although the well bore 12 is shown and described herein as preferably being a vertical well bore, it is understood that it is within the scope of the present invention to position the gas-liquid separator 10 in a directional well bore as long as the longitudinal axis of the well bore is not perpendicular to the direction of the gravitational forces in the well bore as in the case of a horizontal well bore. Nevertheless, for the gas-liquid separator 10 to operate most effectively, the longitudinal axis of the well bore preferably does not deviate more than about 45° from vertical.

The gas-liquid separator of the present invention has general utility in either a cased or an uncased (i.e., open) well bore. Nevertheless, the gas-liquid separator 10 of the present embodiment is preferably utilized in a cased well bore. Accordingly, a tubular well bore casing 16, more specifically termed a production casing, shown cross-sectionally is fixed within the well bore 12 by cementing or other conventional means. A casing shoe 17 is positioned across the bottom opening 18 of the casing 16 to effectively prevent fluid migration from the earthen formation 14 into the casing interior through the bottom opening 18. The casing 16 has a casing inner face 20 and a casing outer face 22. The terms "inner" and "outer" are used herein to designate the relative positions of the recited elements along the radial axis of the well bore 12, wherein "inner" is radially nearer the longitudinal axis of the well bore 12 than "outer". The casing inner face 20 is directed toward the well bore 12 and the casing outer face 22 is directed toward the well bore face 24 of the earthen formation 14. One or more perforations 26, more specifically termed production perforations, are formed in the casing 16 and extend through the casing 16 from the casing outer face 22 to the casing inner face 20.

The production perforations 26 are positioned at a depth point which corresponds to a depth point of a fluid production zone 28 in the earthen formation 14. Accordingly, the production perforations 26 provide fluid communication between the fluid production zone 28 and the well bore 12 (i.e., the casing interior) and enable produced fluids to flow from the fluid production zone 28 through the casing 16 into the well bore 12 as described hereafter. The production perforations 26 are shown as being formed in only one side of the casing 16 for purposes of clarity. However, it is understood that a plurality production perforations are typically distributed around the entire circumference of the casing because the fluid production zone typically surrounds the entire circumference of the casing.

The gas-liquid separator 10 comprises an external tube 30 and an internal tube 32. The terms "external" and "internal" are used herein to designate the relative positions of the recited elements, wherein the "internal" element is surrounded at least in part by the "external" element. The external tube 30 is more specifically termed a gas conduit and the internal tube 32 is more specifically termed a pump intake extension or a stinger in the present embodiment. The external tube 30 has a top end portion 34 and a bottom end portion 36. The terms "top" and "bottom" are used herein to designate the relative positions of the recited elements along the longitudinal axis of the well bore 12 with reference to the earthen surface and the earth center, wherein "top" is closer to the earthen surface than "bottom". The external tube 30 also has an intermediate portion 38 extending between the top and bottom end portions 34, 36 and has an essentially continuous outer face 42.

The internal tube 32 similarly has a top end portion 44 and a bottom end portion 46. The internal tube 32 also has an intermediate portion 48 extending between the top and bottom end portions 44, 46 and has an essentially continuous outer face 52. The internal tube 32 is concentrically positioned within the external tube 30 with the top and bottom end portions 44, 46 of the internal tube 32 extending from the top and bottom end portions 34, 36, respectively, of the external tube 30. By way of example, the height of the external tube 30 is on the order of about 100 to 250 feet and the internal tube 32 extends on the order of about 300 to 500 feet from the bottom end portion 36 of the external tube 30. The height of the internal tube 32 in combination with the production tubing string described hereafter is typically on the order of about 8,000 to 10,000 feet. Due to the relatively long lengths of the external and internal tubes 30, 32, respectively, the external and internal tubes 30, 32 are each typically (although not necessarily) formed by serially joining a plurality of external and internal tube segments 54, 56, respectively, in sealed fixed engagement by means of external and internal tube couplings 58, 60, respectively.

The external tube 30 and internal tube 32 each has an outside diameter, which is substantially less than the inside diameter of the casing 16 (or diameter of the well bore face in the situation of an open well bore) to define an external annulus 62. The external annulus 62 is bounded by the casing inner face 20 (or the well bore face in the situation of an open well bore) and the outer face 42 of the external tube 30. The external annulus 62 is bounded by the casing inner face 20 (or the well bore face in the situation of an open well bore) and the outer face 52 of the internal tube 32 where the internal tube 32 extends beyond the top, or bottom end portions 34, 36 of the external tube 30. The external tube 30 is shown in partial cut-away to expose an inner face 64 of the external tube 30, an external tube interior 66, and the internal tube 32 therein. The internal tube 32 is also shown in partial cut-away to expose an inner face 68 of the internal tube 32 and an internal tube interior 70. The internal tube interior 70 is essentially open along its length to define a reduced-gas fluid flowpath.

The internal tube 32 has an outside diameter which is substantially less than the inside diameter of the external tube 30. For example, the outside diameter of the internal tube 32 is on the order of about 2 ⅞ inches and the inside diameter of the external tube 30 is on the order of about 4 inches. Accordingly, the external and internal tubes 30, 32 define an internal annulus 72 which is bounded on its sides by the inner face 64 of the external tube 30 and the outer face 52 of the internal tube 32. The internal annulus 72 is essentially open along its length to define an internal separated free gas flowpath. The top of the internal annulus 72 is closed off by an external tube hanger 74, which is a conventional tubing hanger connecting the top end portion 34 of the external tube 30 to the internal tube 32. The external tube hanger 74 extends around and fixably engages the outer face 52 of the internal tube 32 proximal to the top end portion 44 of the internal tube 32. The top end portion 34 of the external tube 30 is hung from the external tube hanger 74, which bears the entire weight of the external tube 30 and fixably maintains the concentric position of the internal tube 32 relative to the external tube 30.

The gas-liquid separator 10 further comprises a fixed auger, which has a single fin configuration comprising a spiral plate 76. The spiral plate 76 is arcuately shaped with 1.5 turns about the external tube 38 to encircle the external tube 30 1.5 times. The present invention is not limited by the number of turns of the spiral plate 76 about the external tube 30, but the spiral plate 76 preferably has at least approximately a one-half turn to partially encircle the external tube 30, more preferably at least about 1 turn to fully encircle the external tube 30, and most preferably at least about 1.5 or more turns to multiply encircle the external tube 30.

The spiral plate 76 has a start point 78 (shown in phantom), an end point 80, an upper face 82, a lower face 84, an inner edge 86, and an outer edge 88. The spiral plate 76 is positioned in the external annulus 62 and is preferably fixed to the intermediate portion 38 of the external tube 30. The linear height of the spiral plate 76 from the start point 78 to the end point 80 is, for example, on the order of about 1 to 2 feet. The width of the upper face 82 and the lower face 84 are identical, being about equal to the width of the external annulus 62. The inner edge 86 of the spiral plate 76 is helically configured to spirally track the outer face 42 of the external tube 30. The inner edge 86 conformingly and fixably engages the outer face 42 of the external tube 30 along the intermediate portion 38 of the external tube 30. The junction of the inner edge 86 and the outer face 42 preferably essentially forms a seal to prevent the substantial flow of fluids between the inner edge 86 and the outer face 42.

The spiral plate 76 has a diameter approximately equal to the inside diameter of the casing 16 (or the well bore face in the situation of an open well bore). As such, the outer edge 88 of the spiral plate 76 is helically configured to spirally track the casing inner face 20 of the casing 16 (or the well bore face in the situation of an open well bore). The outer edge 88 conformingly engages the casing inner face 20 (or the well bore face in the situation of an open well bore). The outer edge 88 and the casing inner face 20 (or the well bore face in the situation of an open well bore) are preferably in tight fitting engagement with one another at their interface to essentially form a seal which prevents the substantial flow of fluids between the outer edge 88 and the casing inner face 20 (or the well bore face in the situation of an open well bore). The start and end points 78, 80 and upper and lower faces 82, 84 of the spiral plate 76, the outer face 42 of the external tube 30, and the casing inner face 20 (or the well bore face in the situation of an open well bore) bound a restrictive curved flow channel 90 through the external annulus 62, which is more specifically termed a spiral channel. The spiral channel 90 corresponds to the spiral plate 76 insofar as the spiral channel 90 preferably spirally descends at least approximately a one-half complete turn, more preferably at least approximately 1 turn, and most preferably at least approximately 1.5 or more turns about the outer face 42 of the external tube 30, as shown in the present embodiment.

The gas-liquid separator 10 further comprises a lower first internal annulus opening, which provides fluid communication between the internal annulus 72 and the external annulus 62. The lower first internal annulus opening is positioned in the external tube 30 at a point or points beyond the start point 78 of the spiral plate 76 and preferably at a point or points beyond the end point 80 of the spiral plate 76 proximal to the bottom end portion 36 of the external tube 30. The lower first internal annulus opening defines a separated free gas inlet port which opens into the internal separated free gas flowpath (i.e., the internal annulus 72) from the exterior thereof.

In accordance with the present embodiment, the bottom end portion 36 of the external tube 30, more specifically termed a gas cone and shown in partial cut-away, has a flared or conical configuration, which increases in diameter with distance away from the spiral plate 76. In contrast, the top end portion 34 and the intermediate portion 38 of the external tube 30 each has a substantially constant outside diameter along its length approximately equal to the diameter of the other, for example, on the order of about 4 ½ inches. The bottom end portion 36 has opposite ends, in particular a narrow end 92 and a flared end 94. The narrow end 92 is more proximal to the spiral plate 76 than the flared end 94 and is coupled with the intermediate portion 38 of the external tube 30. The narrow end 92 has a diameter which is approximately equal to that of the intermediate portion 38. The flared end 94 is a free end opposite the narrow end 92 and has a diameter which is substantially greater than that of the narrow end 92 and the intermediate portion 38, for example, on the order of about 6 ½ inches. The flared end 94 is open to the external annulus 62 to define a flared orifice 96. Because the flared orifice 96 dimensionally corresponds to the open flared end 94, the flared orifice 96 has a diameter approximately equal to the diameter of the flared end 94.

A plurality of flared perforations 98 are also distributed along the bottom end portion 36 of the external tube 30 above the flared orifice 96 more proximal to the spiral plate 76. The flared perforations 98 are formed in the wall of the external tube 30 and extend from the outer face 42 to the inner face 64. Like the flared orifice 96, the flared perforations 98 provide fluid communication between the internal annulus 72 and the external annulus 62, albeit through the wall of the external tube 30 rather than through the open flared end 94. The diameter of each of the flared perforations 98 is approximately equal to the others (for example, on the order of about ⅝ to ¾ inches) and is substantially less than the diameter of the flared orifice 96. In the present embodiment, the lower first internal annulus opening comprises in combination the flared orifice 96 and the plurality of flared perforations 98 which functionally complement one another as described hereafter. However, in accordance with alternate embodiments not shown, the lower first internal annulus can consist essentially of the flared orifice 96 alone, the plurality of flared perforations 98 alone, or other configurations of single or multiple orifices readily apparent to the skilled artisan.

The gas-liquid separator 10 further comprises an internal tube interior opening, which provides fluid communication between the internal tube interior 70 and the external annulus 62. The internal tube interior opening is positioned in the internal tube 32 at a point or points beyond the start point 78 of the spiral plate 76 and preferably at a point or points beyond the end point 80 of the spiral plate 76. The internal tube opening is more preferably positioned at a point or points above the casing shoe 17 and below the lower first internal annulus opening 96, 98 proximal to the bottom end portion 46 of the internal tube 32, which extends from the bottom end portion 36 of the external tube 30. The internal tube interior opening defines a reduced-gas fluid inlet port which opens into the reduced-gas fluid flowpath (i.e., the internal tube interior 70) from the exterior thereof.

In accordance with the present embodiment, the top end portion 44, intermediate portion 48, and bottom end portion 46 of the internal tube 32 each has a substantially constant diameter along its length approximately equal to the diameter of the other, for example, on the order of about 2 ⅜ inches. The bottom end portion 46, more specifically termed a perforated tubing sub or an artificial lift intake point in the present embodiment, has a plurality of internal tube interior perforations 100 distributed along a free end 102 of the bottom end portion 46 of the internal tube 32. The internal tube interior perforations 100 are positioned below the flared orifice 96 and flared perforations 98 more distal from the spiral plate 76. The internal tube interior perforations 100 are formed in the wall of the internal tube 32 and extend through the internal tube 32 from the outer face 52 to the inner face 68. The diameter of each of the internal tube interior perforations 100 is approximately equal to the others, for example, on the order of about ½ to ⅝ inches. In the present embodiment, the internal tube interior opening comprises the plurality of internal tube interior perforations 100. However, in accordance with alternate embodiments not shown, the internal tube interior opening can consist essentially of a single enlarged orifice rather than a plurality of perforations.

A perforated disk 104, more specifically termed a vortex spoiler, shown in partial cut-away is positioned in the external annulus 62, preferably below the bottom end portion 36 of the external tube 30 and above the bottom end portion 46 of the internal tube 32. The perforated disk 104 is more preferably positioned between the lower first internal annulus opening 96, 98 and the internal tube interior opening 100. The perforated disk 104 has a circular planar configuration with a diameter approximately equal to or less than the inside diameter of the casing 16 (or diameter of the well bore face in the situation of an open well bore) to fit within the external annulus 62. The plane of the perforated disk 104 is aligned in the external annulus 62 substantially perpendicular to the longitudinal axis of internal tube 32 and the well bore 12.

The perforated disk 104 has an upper face 106, a lower face 108, a central opening 110, an outer edge 112, and a plurality of disk perforations 114 distributed across the upper and lower faces 106, 108. The central opening 110 has a diameter greater than the outside diameter of the internal tube 32 which enables the internal tube 32 to readily pass through the central opening 110. Each of the plurality of disk perforations 114 has a diameter approximately equal to the others, for example, on the order of about ⅝ to ¾ inches, and each extends through the perforated disk 104 from the upper face 106 to the lower face 108, thereby enabling fluid communication between the external annulus 62 on opposite sides of the disk 104.

The gas-liquid separator 10 further comprises an upper second internal annulus opening, which, like the lower first internal annulus opening, provides fluid communication between the internal annulus 72 and the external annulus 62. However, the upper second internal annulus opening is positioned in the external tube 30 at a point or points above the start point 78 of the spiral plate 76 and preferably at a point or points proximal to the top end portion 34 of the external tube 30. The upper second internal annulus opening defines an internal separated free gas outlet port which opens from the internal annulus 72 into the exterior thereof.

In the present embodiment, a plurality of external tube perforations 118 are distributed around the top end portion 34 of the external tube 32 below the external tube hanger 74, which define the upper second internal annulus opening. Each external tube perforation 118 has a diameter approximately equal to the diameter of each flared perforation 98, i.e., for example, on the order of about ⅝ to ¾ inches. The external tube perforations 118 are formed in the wall of the external tube 30 and extend from the outer face 42 to the inner face 64 to provide fluid communication between the internal annulus 72 and the external annulus 62, through the wall of the external tube 30. A sufficient number of external tube perforations 118 are provided so that the total surface area of all the external tube perforations 118 is about equal to or greater than the cross sectional area of the internal annulus 72 to minimize back pressure in the internal annulus 72. In the present embodiment, the upper second internal annulus opening comprises the plurality of external tube perforations 118. However, in accordance with alternate embodiments not shown, the upper second internal annulus opening can consist essentially of a single enlarged orifice rather than a plurality of perforations.

The gas-liquid separator 10 terminates at the top end portion 44 of the internal tube 32. The top end portion 44 has a proximal end 120 and a distal end 122, wherein the terms "proximal" and "distal" are relative to the spiral plate 76. The proximal end 120 is coupled with the intermediate portion 48 of the internal tube 32 and the distal end 122 is coupled with a down hole artificial lift assembly, which is structurally and functionally cooperative with the gas-liquid separator 10. The artificial lift assembly of the present embodiment is generally designated 124. The artificial lift assembly 124 is an in-line assembly comprising in series a conventional submersible pump 126 and a shroud 128 which houses a conventional electric pump motor (not shown). It is understood that the present invention is not limited to the specific artificial lift assembly 124 described herein by way of example. It is within the scope of the present invention to employ alternate conventional artificial lift assemblies in cooperation with the gas-liquid separator 10, which are within the purview of the skilled artisan.

In any case, the artificial lift assembly 124 further comprises a swage 130 positioned at the junction of the shroud 128 and the distal end 122, which transitions the distal end 122 into the shroud 128. A shroud hanger 132 is positioned at the junction of the shroud 128 and the submersible pump 126 to couple them together. A production tubing string 134 extends upwardly from the submersible pump 126 through the well bore 12 to the earthen surface (not shown). The production tubing string 134 has a diameter approximately equal to the diameter of the internal tube 32. The production tubing string 134 and artificial lift assembly 124 in series extend the reduced-gas fluid flowpath from the internal tube interior 70 to the earthen surface by providing fluid communication therebetween. An auxiliary line 136, such as an electric cable or one or more capillary strings, is optionally run from the earthen surface to the artificial lift assembly 124 through the well bore 12 alongside the production tubing string 134 to serve the artificial lift assembly 124.

The artificial lift assembly 124 and production tubing string 134 each has an outside diameter, which is substantially less than the inside diameter of the casing 16 (or diameter of the well bore face in the situation of an open well bore), thereby extending the external annulus 62 through the well bore 12 from the top end portion 44 of the internal tube 32 to the earthen surface. The artificial lift assembly 124 and production tubing string 134 are appropriately configured such that they do not substantially impede the flow of fluids through the external annulus 62.

Substantially all of the above-described components of the gas-liquid separator 10 are fabricated from high-strength, durable, relatively rigid materials, such as steel or the like, which do not readily physically deform or chemically degrade under normal down hole operating conditions. The gas-liquid separator 10 is a static apparatus, which has essentially no moving parts exclusive of the artificial lift assembly 124. Thus, the gas-liquid separator 10 remains static relative to the well bore 12 during operation once it is placed down hole in a manner described hereafter. The gas-liquid separator 10 has been described above as being assembled from a number of discrete individual components, but it is understood that the present invention is not so limited. Combinations of one or more above-described components of the gas-liquid separator 10 can alternatively be integrally fabricated as single components. Finally, it is noted that a number of dimensional values are recited above. These values are recited merely by way of example and are not to be construed in any way as limiting the scope of the present invention.

Figure 2A:
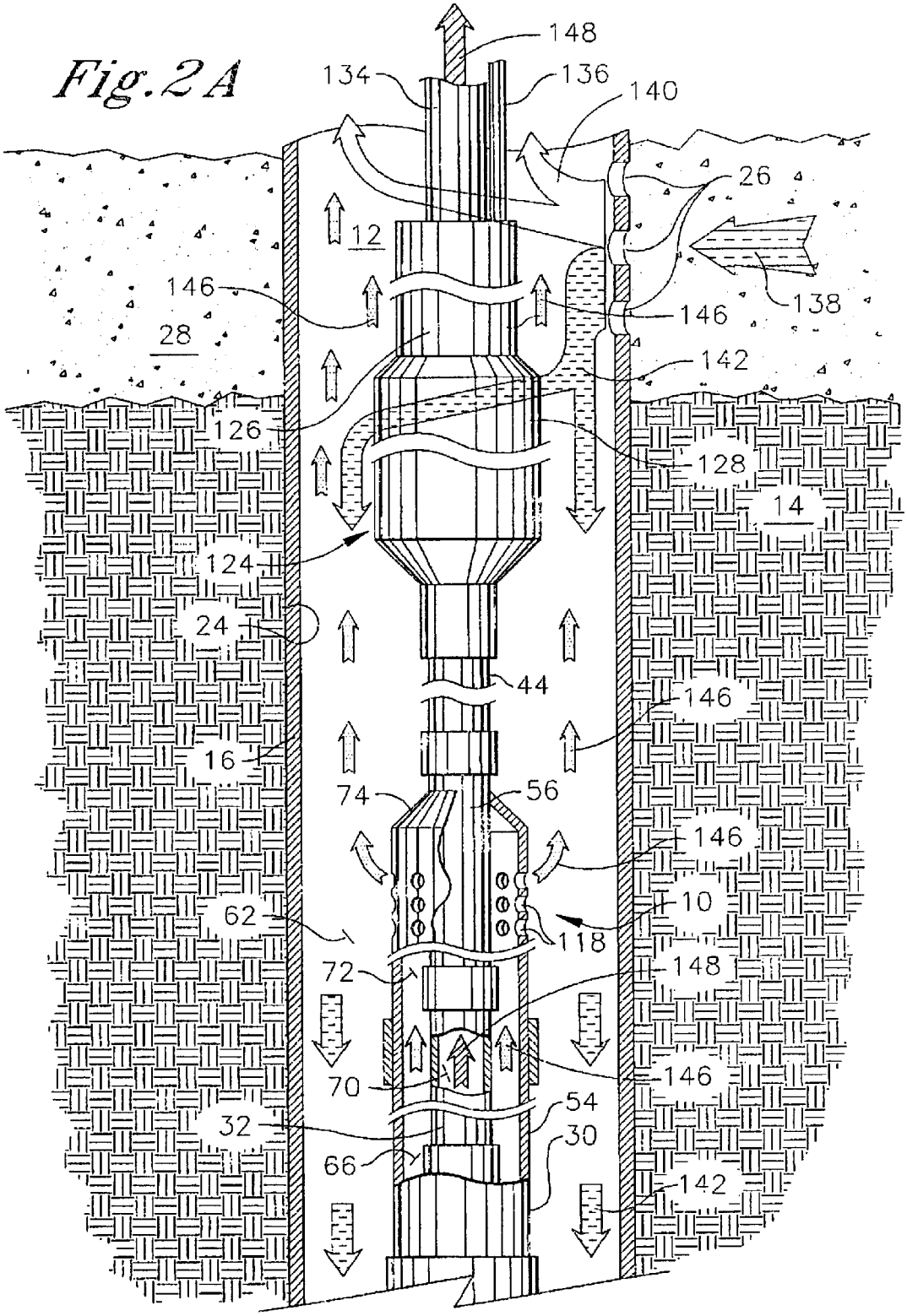
FIGS. 2A and 2B are a conceptualized operational view of the gas-liquid separator of FIGS. 1A and 1B.
Figure 2B:
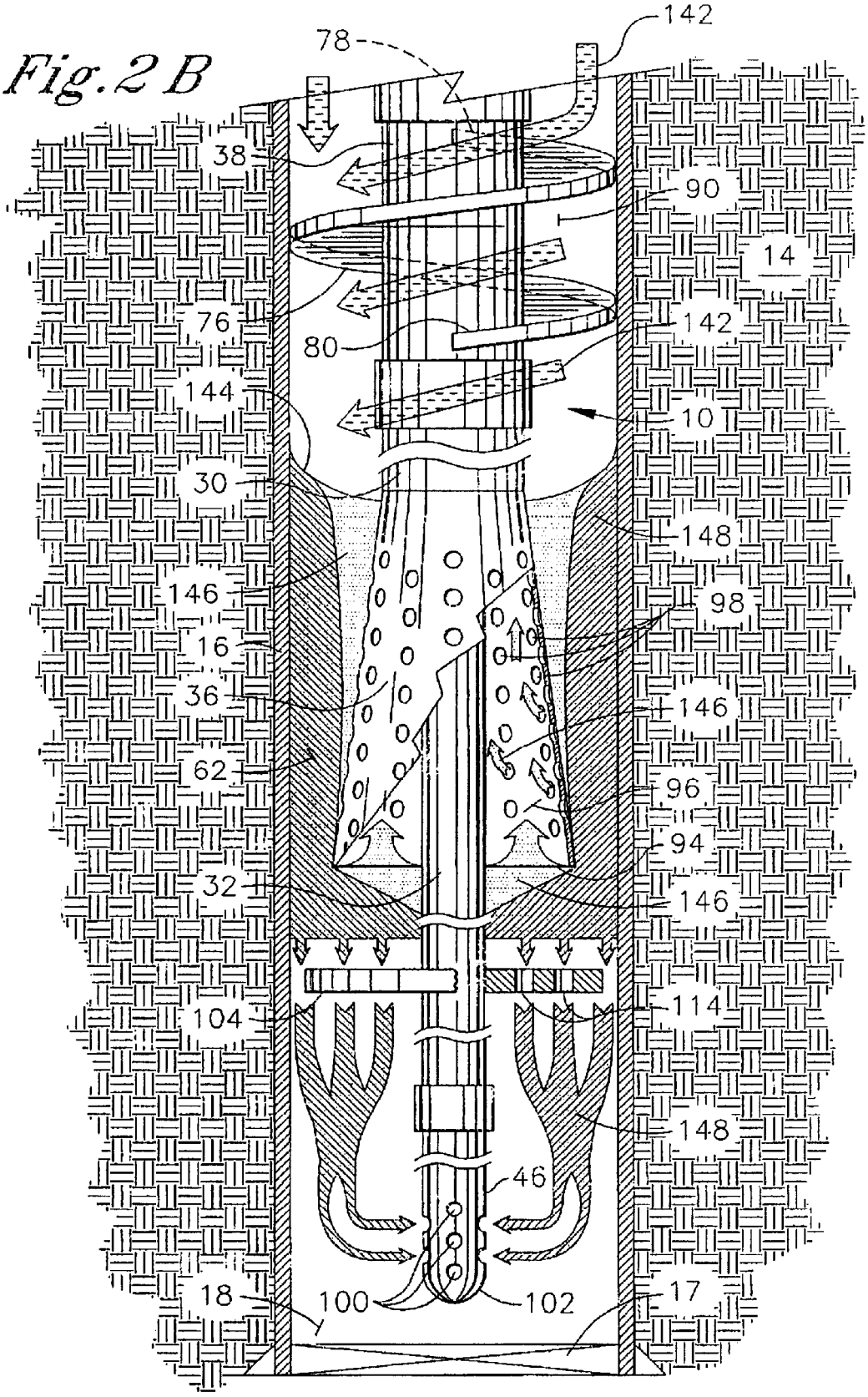

Operation of the gas-liquid separator 10 is described hereafter with continuing reference to FIGS. 1A and 1B and further reference to FIGS. 2A and 2B. The gas-liquid separator 10 and associated artificial lift assembly 124 and production tubing string 134 are mounted in series within the well bore 12. In accordance with the present embodiment, the entire gas-liquid separator 10, including the spiral plate 76 and external tube perforations 118, is positioned below the production perforations 26. Produced fluids designated by the arrow 138 are displaced from a depth point in the fluid production zone 28 through the production perforations 26 into the external annulus 62. The produced fluids 138 comprise in combination oil, water and gas. The produced fluids 138 diverge at the production perforations 126 into two streams, a produced free gas designated by arrows 140 and a produced fluid mixture designated by arrows 142. The produced free gas 140 is a hydrocarbon gas, such as natural gas, which is conveyed by its own buoyancy up the segment of the external annulus 62 above the gas-liquid separator 10 and artificial lift assembly 124, specifically termed the casing/tubing annulus, to the well head (not shown) at the earthen surface. The produced fluid mixture 142 includes primarily oil and water in a liquid state and a hydrocarbon gas in a gaseous state. The liquids are typically combined in a suspension or emulsion and the gas is dissolved or otherwise entrained in the liquids. The produced fluid mixture 142 descends through the production perforations 26 down the external annulus 62 past the artificial lift assembly 124 under the force of gravity to the gas-liquid separator 10.

The components of the gas-liquid separator 10 functionally partition the external annulus 62 adjacent thereto into a plurality of functional chambers which extend continuously in series the length of the gas-liquid separator 10. In particular, the segment of the external annulus 62 between the external tube perforations 118 and the start point 78 of the spiral plate 76 is characterized as a produced fluid mixture conveyance chamber, which directs the produced fluid mixture 142 downward to the spiral plate 76. The segment of the external annulus 62 between the start point 78 and end point 80 of the spiral plate 76 (i.e., the spiral channel 90) is characterized as a gas-liquid separation chamber. As the produced fluid mixture 142 descends through the spiral channel 90, the produced fluid mixture 142 spins about the external tube 30, which in turn causes centrifugal separation of the oil, water and gas in the produced fluid mixture 142 due to density differences between them. In particular, separated free gas is concentrated more proximal to the outer face 42 of the external tube 30 than the liquids (i.e., toward the inner portion of the spiral channel 90).

The segment of the external annulus 62 below the spiral plate 76 and above the perforated disk 104 (i.e., adjacent to the bottom end portion 36 of the external tube 30) is characterized as a separated free gas recovery chamber. When the fluids descend out of the spiral channel 90 into the separated free gas recovery chamber, they continue to spin about the external tube 30, thereby forming a vortex 144. Separated free gas 146 is forced to the center of the vortex 144. The remainder of the vortex 144 is a reduced-gas fluid 148 (primarily oil and water in a liquid state), which moves toward the outside of the vortex 144. The separated free gas 146 at the center of the vortex 144 is compressed by the outward flaring bottom end portion 36 of the external tube 30, which forces the separated free gas 146 through the flared perforations 98 into the internal annulus 72.

The vortex 144 is essentially stopped at the point where the vortex 144 contacts the upper face 106 of the perforated disk 104. When the vortex 144 is stopped or is "spoiled" at the upper face 106, the remaining separated free gas 146 from the vortex 144 is discharged upward through the flared orifice 96 into the internal annulus 72 and combines with the separated free gas 146 which has entered the internal annulus 72 through the flared perforations 98. The separated free gas 146 is conveyed by its own buoyancy up through the internal annulus 72 until it reaches the external tube perforations 118. The separated free gas 146 is discharged upward from the internal annulus 72, out the external tube perforations 118, and into the external annulus 62 below the production perforations 26. The separated free gas 146 continues traveling upward through the external annulus 62 past the artificial lift assembly 124 counter-current to the produced fluid mixture 142. The separated free gas 146 mixes with the produced free gas 140 at the production perforations 26 and continues upward as a free-gas or coalesced in large gas bubbles through the casing/tubing annulus to the well head at the earthen surface. The separated free gas 146 and produced free gas 140 are captured at the well head for further treatment and/or downstream applications.

The segment of the external annulus 62 between the perforated disk 104 and the internal tube interior perforations 100 (i.e., adjacent to the bottom end portion 46 of the internal tube 32 extending from the external tube 30) is characterized as a reduced-gas fluid recovery chamber. As described above, when the perforated disk 104 stops the vortex 144, the separated free gas 146 rises into the internal annulus 72. However, the reduced-gas fluid 148 does not rise because it is heavier, containing mostly liquids. Accordingly, the reduced-gas fluid 148 passes downward through the disk perforations 114 of the perforated disk 104 into the reduced-gas fluid recovery chamber, where the reduced-gas fluid 148 is drawn through the internal tube interior perforations 100 into the internal tube interior 70. The artificial lift system 124 pumps the reduced-gas fluid 148 upward through the internal tube interior 70, past the artificial lift system 124, and through the production tubing string 134. The reduced-gas fluid 148 is captured at the well head for further treatment and/or downstream applications.

By way of example, the produced fluids entering the well bore typically contain within a range of about 95 to 97% gases by volume, the remainder being liquids. Before being processed by the gas-liquid separator of the present invention, the produced fluid mixture typically contains within a range of about 10 to 15% gases by volume, the remainder being liquids. After being processed by the gas-liquid separator of the present invention, the final gas-reduced fluid typically contains within a range of about 3 to 4% gases by volume, the remainder being liquids. Thus, the present gas-liquid separator effectively reduces the gas volume of the produced fluid mixture by about 60 to 80%.

Figure 3A:
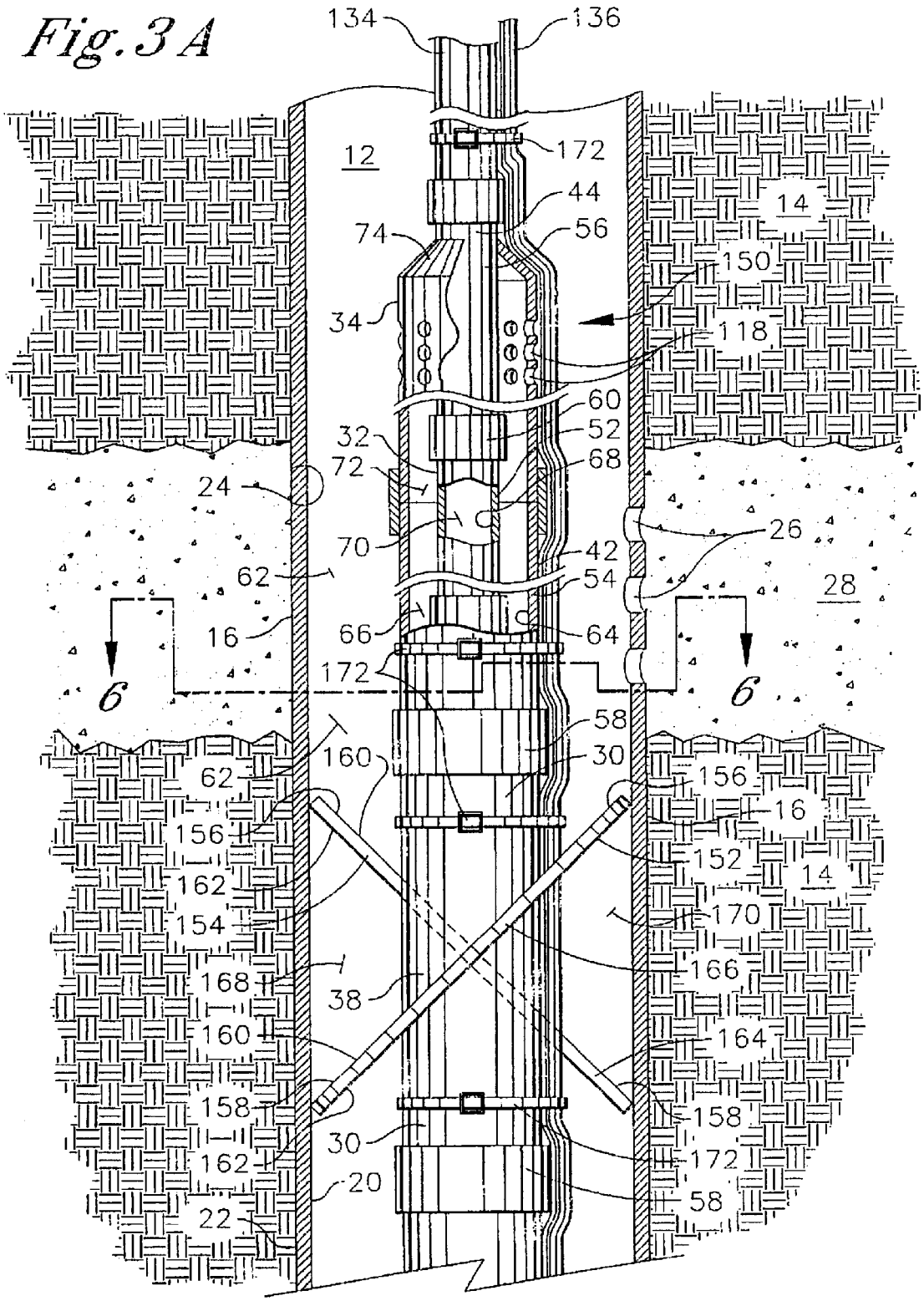
FIGS. 3A and 3B are an elevational view of an alternate embodiment of a gas-liquid separator of the present invention positioned in a cased well bore.
Figure 3B:
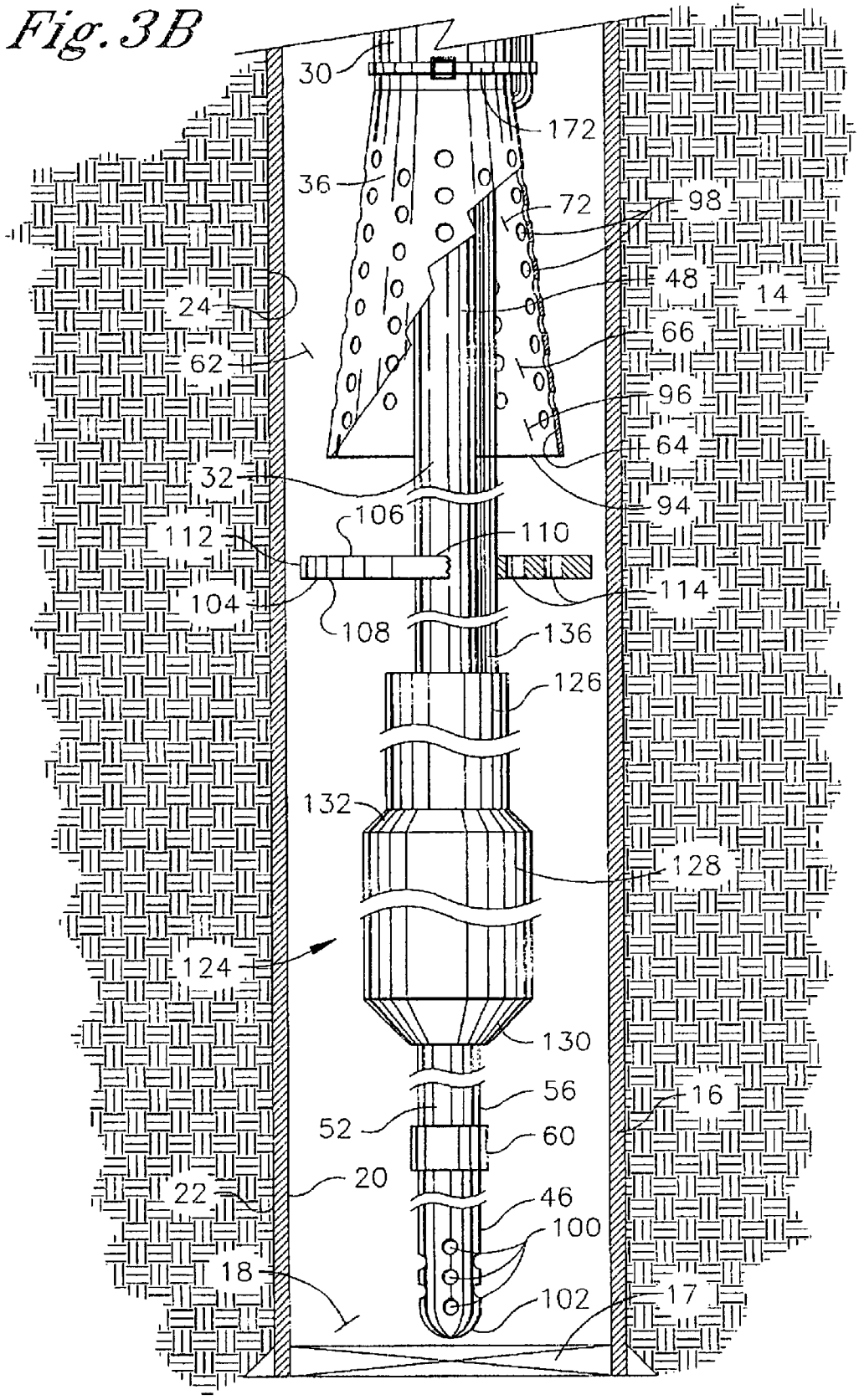

Referring to FIGS. 3A and 3B, an alternate embodiment of a gas-liquid separator of the present invention is shown and generally designated 150. The gas-liquid separator 150 of FIGS. 3A and 3B is essentially identical to the gas-liquid separator 10 of FIGS. 1A and 1B except for the configuration of the fixed auger, the position of the artificial lift assembly relative to the fixed auger, and the position of the second internal annulus opening relative to the production perforations. Accordingly, elements of the gas-liquid separator 150 in FIGS. 3A and 3B which correspond to elements of the gas-liquid separator 10 in FIGS. 1A and 1B are identified by the same reference characters.

Figure 4:
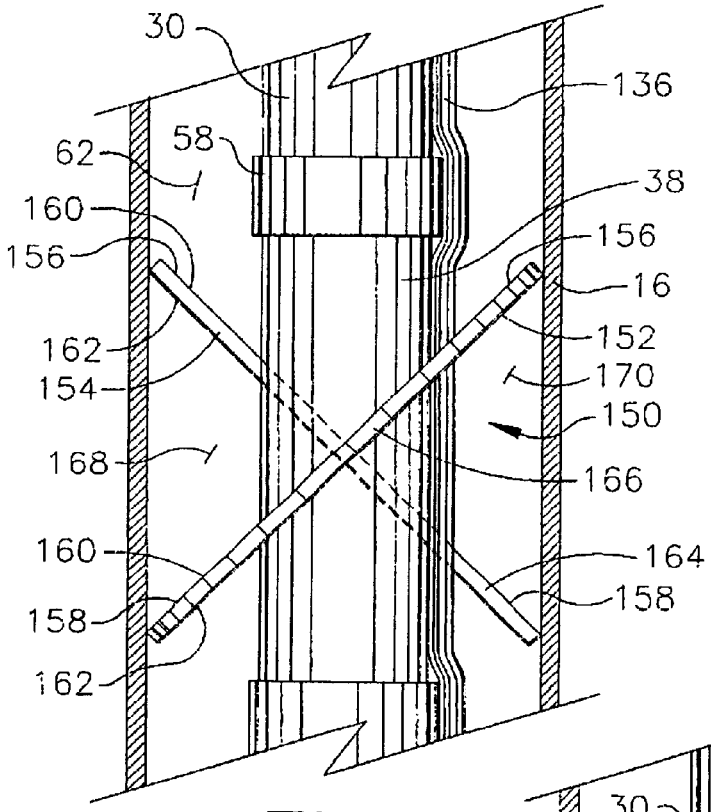
FIG. 4 is an elevational view of the fixed auger of the gas-liquid separator of FIG. 3A.
Figure 5:
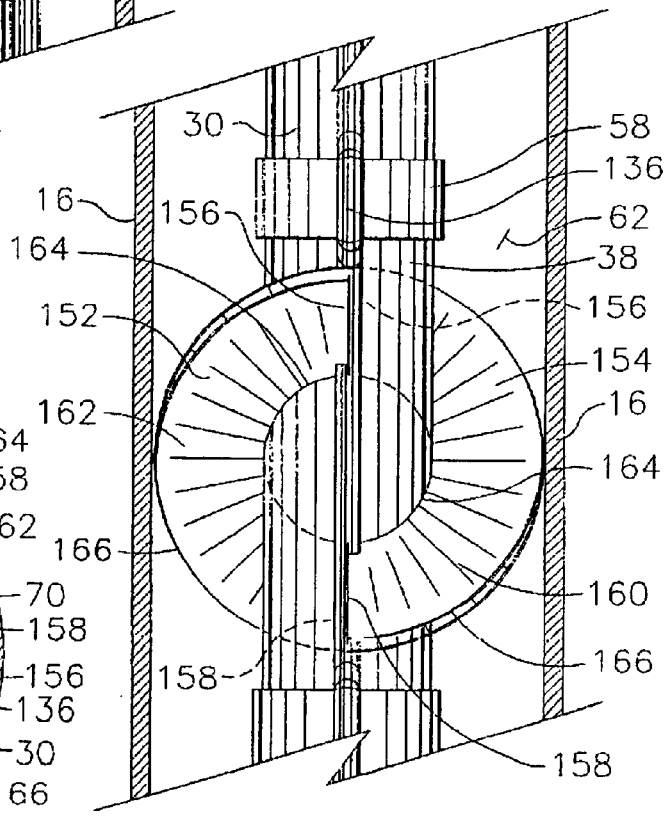
FIG. 5 is an elevational view of the fixed auger of the gas-liquid separator of FIG. 4, but rotated 90° from the view of FIG. 4.

Referring additionally to FIGS. 4 and 5, the fixed auger of the gas-liquid separator 150 has a dual fin configuration comprising a first pitched plate 152 and a second pitched plate 154. The first and second pitched plates 152, 154 are configured substantially identical to each other. Each pitched plate 152, 154 is arcuately shaped and forms a half circle. As such, each pitched plate 152, 154 has a one-half turn to partially encircle the external tube 30. The present invention is not limited by the number of turns of each pitched plate 152, 154 about the external tube 30, but each pitched plate 152, 154 has at least a partial turn, preferably at least a one-quarter turn, and most preferably at least a one-half turn about the external tube 30.

Each pitched plate 152, 154 has a start point 156, an end point 158, an upper face 160, a lower face 162, an inner edge 164, and an outer edge 166. Each pitched plate 152, 154 is preferably fixed to the intermediate portion 38 of the external tube 30 and is positioned in the external annulus 62 at a pitch angle of about 45° with reference to the longitudinal axes of the well bore 12 and the external and internal tubes 30, 32. The pitched plates 152, 154 are positioned in parallel to one another. The term "parallel" refers to a position, whereby the first pitched plate 152 is substantially fixed to the opposite side of the external tube 30 from the second pitched plate 154, but at substantially the same vertical level on the external tube 30. The linear height of each pitched plate 152, 154 from the start point 156 to the end point 158, for example, is on the order of about 1 to 2 feet. The width of the upper face 160 and the lower face 162 are identical, being about equal to the width of the external annulus 62. The inner edge 164 of each pitched plate 152, 154 conformingly and fixably engages the outer face 42 of the external tube 30 along the intermediate portion 38 of the external tube 30. The junction of the inner edge 164 and the outer face 42 preferably essentially forms a seal to prevent the substantial flow of fluids between the inner edge 164 and the outer face 42.

Each pitched plate 152, 154 has a diameter approximately equal to the inside diameter of the casing 16 (or the well bore face in the situation of an open well bore). As such, the outer edge 166 of each pitched plate 152, 154 is configured to conformingly engage the casing inner face 20 (or the well bore face in the situation of an open well bore). The outer edge 166 and the casing inner face 20 (or the well bore face in the situation of an open well bore) are preferably in tight fitting engagement with one another to essentially form a seal which prevents the substantial flow of fluids between the outer edge 166 and the casing inner face 20 (or the well bore face in the situation of an open well bore). The start and end point 156, 158 and upper and lower faces 160, 162 of each pitched plate 152, 154, the outer face 42 of the external tube 30 and the casing inner face 20 (or the well bore face in the situation of an open well bore) bound restrictive first and second curved flow channels 168, 170, respectively, through the external annulus 62, which are more specifically termed first and second pitched channels. Each pitched channel 168, 170 corresponds to each pitched plate, respectively, insofar as each pitched channel 168, 170 preferably descends in at least a partial turn, more preferably at least a one-quarter turn, and most preferably a one-half turn about the outer face 42 of the external tube 30, as shown in the present embodiment.

Figure 6:
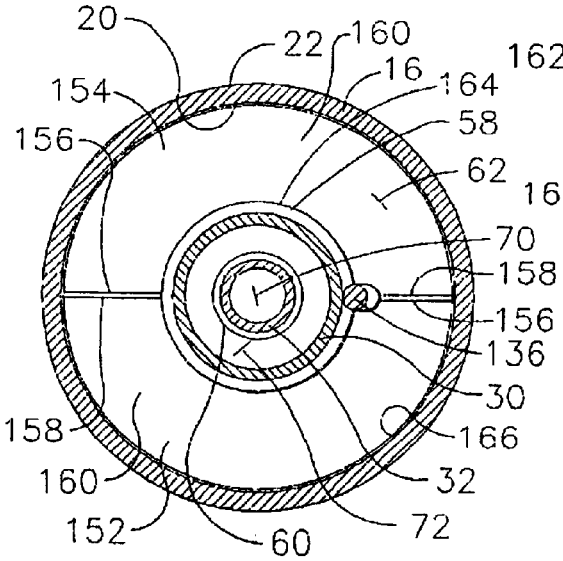
FIG. 6 is a cross-sectional view of the gas-liquid separator of FIG. 3A taken along cross section line 6—6

The down hole artificial lift assembly 124 is integral with the gas-liquid separator 150 and is positioned in-line with the internal tube 32 between the perforated disk 104 and the internal tube interior perforations 100 beneath the first and second pitched plates 152, 154. The auxiliary line 136 extends from the earthen surface alongside the production tubing string 134, the top end portion 44 of the internal tube 32, the external tube 30 (down to the bottom end portion 36), and the bottom end portion 46 of the internal tube 32 until reaching the artificial lift assembly 124. An opening (not-shown) is formed through the bottom end portion 36 which directs the auxiliary line 136 from the outer face 42 of the external tube 30 into the external tube interior 66 at the bottom end portion 36. A plurality of metal straps 172, such as stainless steel bands, are periodically provided along the length of the gas-liquid separator 150, which fixably secure the auxiliary line 136 to the top end portion 44 of the internal tube 32, the external tube 30 down to the bottom end portion 36, and the bottom end portion 46 of the internal tube 32 down to the artificial lift assembly 124. The relative positions of the auxiliary line 136, external tube 30, internal tube 32, and casing 16 are shown with reference to FIG. 6.

Figure 7A:
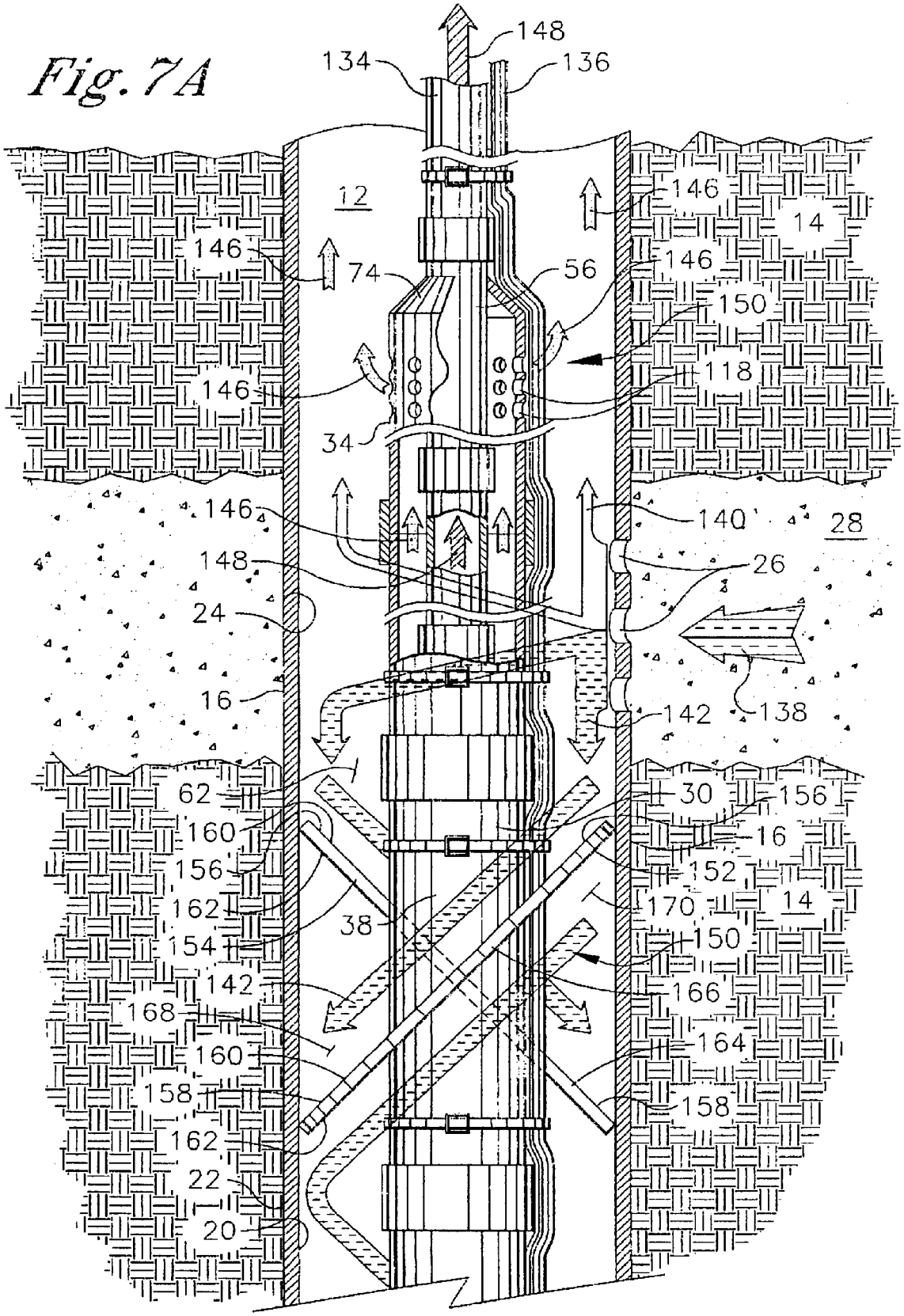
FIGS. 7A and 7B are a conceptualized operational view of the gas-liquid separator of FIGS. 3A and 3B.
Figure 7B:
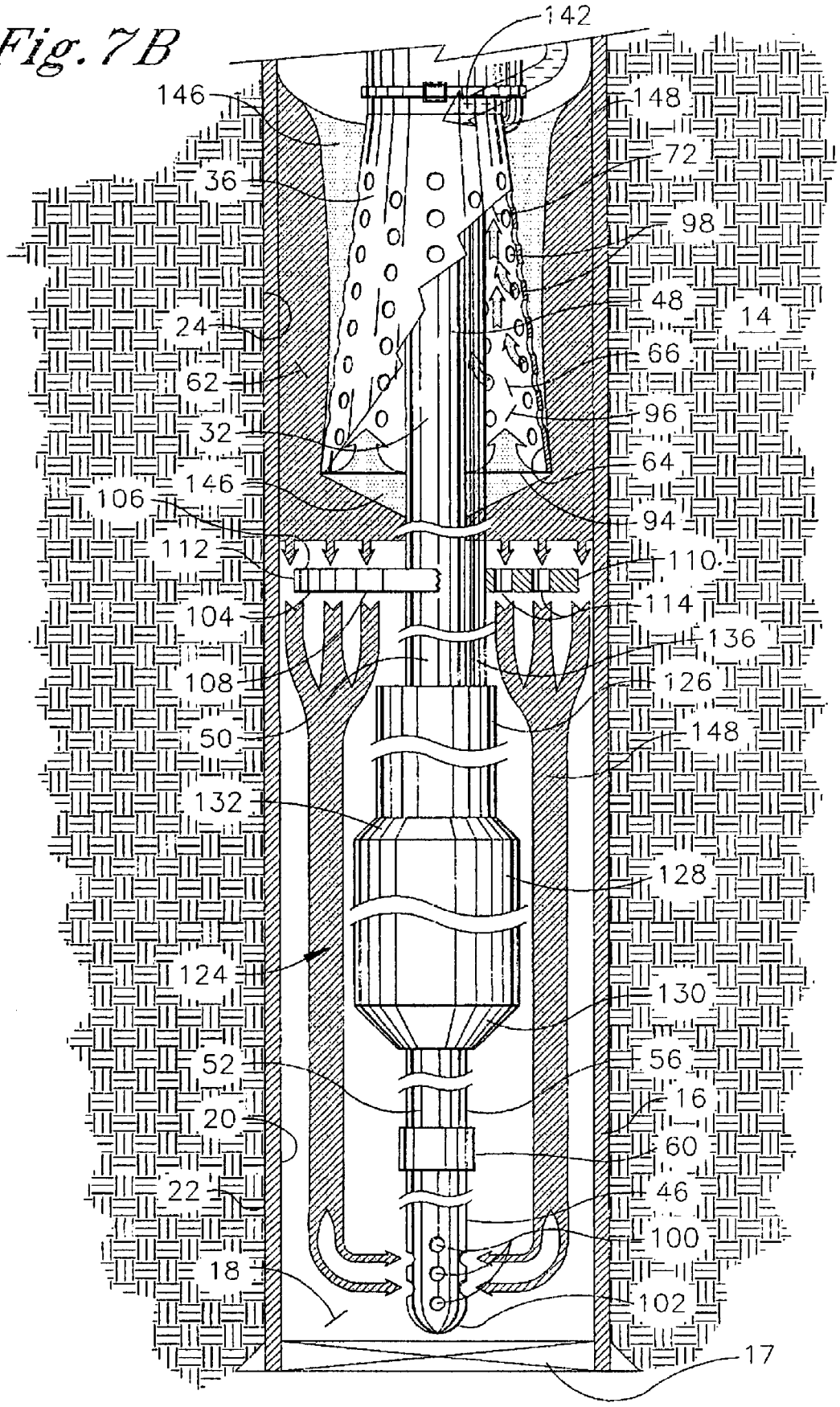

Operation of the gas-liquid separator 150 is substantially similar to operation of the gas-liquid separator 10 described above. Operation of the gas-liquid separator is summarized hereafter with continuing reference to FIGS. 3A and 3B and further reference to FIGS. 7A and 7B. The gas-liquid separator 150 (including the integral artificial lift assembly 124) and production tubing string 134 are mounted in series within the well bore 12. In accordance with the present embodiment, the first and second pitched, plates 152, 154 are positioned in the well bore 12 below the production perforations 26 and the external tube perforations 118 are positioned in the well bore 12 above the production perforations 26. The produced fluids designated by the arrow 138 are displaced from a depth point in the fluid production zone 28 through the production perforations 26 into the external annulus 62 below the external tube perforations 118. The produced fluids 138 diverge at the production perforations 126 into the produced free gas designated by the arrows 140 and the produced fluid mixture designated by the arrows 142. The produced free gas 140 is conveyed up the casing/tubing annulus to the well head, while the produced fluid mixture 142 descends down the external annulus 62. The produced fluid mixture conveyance chamber, which is the segment of the external annulus 62 between the production perforations 26 and the start points 156 of the first and second pitched plates 152, 154, directs the produced fluid mixture 142 downward to the pitched plates 152, 154.

The gas-liquid separation chamber, which is defined by the first and second pitched channels 168, 170, centrifugally separates the oil, water and gas in the produced fluid mixture 142 in substantially the same manner as described above with respect to the gas-liquid separator 10. The circular fluid flow through the gas-liquid separation chamber causes vortex formation in the separated free gas recovery chamber, which is the segment of the external annulus 62 below the first and second pitched channels 168, 170 and above the perforated disk 104. The separated free gas 146 is forced into the internal annulus 72 via the lower first internal annulus opening 96, 98 and conveyed up through the internal annulus 72 to the external tube perforations 118 and out into the external annulus 62 above the production perforations 26. The separated free gas 146 mixes with the produced free gas 140 from the production perforations 26 in the external annulus 62 and continues upward as a free gas or coalesced in large gas bubbles through the casing/tubing annulus to the well head.

The remaining reduced-gas fluid 148 continues downward into the reduced-gas fluid recovery chamber, which is the segment of the external annulus 62 from below the perforated disk 104 to the internal tube interior perforations 100, and is drawn through the internal tube interior perforations 100 into the internal tube interior 70. The artificial lift system 124 pumps the reduced-gas fluid 148 upward through the internal tube interior 70 and production tubing string 134 to the well head.

Although the gas-liquid separator 150 is described above as being positioned in the well bore 12 with the first and second pitched plates 152, 154 below the production perforations 26 and the external tube perforations 118 above the production perforations 26, it is within the scope of the present invention to position the entire gas-liquid separator 150, including the first and second pitched plates 152, 154 and external tube perforations 118, below the production perforations 26, in the manner described above with respect to the gas-liquid separator 10. Conversely, it is within the scope of the present invention, and generally preferred, to position the spiral plate 76 of the gas-liquid separator 10 below the production perforations 26 and the external tube perforations 118 above the production perforations 26 in the manner described above with respect to the gas-liquid separator 150.

Further alternate embodiments of a gas-liquid separator not shown are within the scope of the present invention, wherein the fixed auger is alternately configured, but functions in substantially the same manner as the fixed augers of the above-recited embodiments to spin the produced fluid mixture about the external tube and effect centrifugal separation of the oil, water and gas in the produced fluid mixture. For example, the fixed auger of an alternate gas-liquid separator may include three or more pitched plates serially and/or parallely positioned along the length of the external tube. The term "serial" refers to a position, whereby multiple pitched or spiral plates are substantially fixed to the external tube at different vertical levels on the external tube. The fixed auger of another alternate gas-liquid separator may include multiple spiral plates serially and/or parallely positioned along the length of the external tube. The fixed auger of yet another alternate gas-liquid separator may include one or more pitched plates serially and/or parallely positioned in combination with one or more spiral plates along the length of the external tube.

While the forgoing preferred embodiments of the invention have been described and shown, it is understood that alternatives and modifications, such as those suggested and others, may be made thereto and fall within the scope of the invention.

We claim:

1. A gas-liquid separator positionable down hole in a well bore comprising:

an external tube having an external tube interior;

an internal tube having an internal tube interior defining a reduced-gas fluid flowpath, wherein said internal tube is positioned in said external tube interior to form an internal annulus between said external tube and said internal tube, said internal annulus defining a free gas flowpath;

a plate having a start point and at least partially encircling said external tube to form a curved flow channel defining a produced fluid mixture flowpath;

an internal annulus opening beyond said start point defining a free gas inlet port for said free gas flowpath, wherein said external tube has a flared portion positioned at or proximal to said internal annulus opening and flaring outwardly as said flared portion extends away from said start point of said plate; and an internal tube interior opening beyond said start point defining a reduced-gas fluid inlet port for said reduced-gas fluid flowpath.

2. The gas-liquid separator of claim 1, wherein said internal tube has a longitudinal axis and said external tube has a longitudinal axis, and further wherein said longitudinal axis of said internal tube is substantially aligned with said longitudinal axis of said external tube.

3. The gas-liquid separator of claim 1 wherein said internal tube extends from said external tube interior beyond said internal annulus opening.

4. The gas-liquid separator of claim 1 wherein said internal annulus opening comprises a plurality of flared perforations extending through said flared portion of said external tube.

5. The gas-liquid separator of claim 1 further comprising a disk having a plurality of disk perforations extending through said disk, wherein said disk is positioned above said internal tube interior opening and below said internal annulus opening.

6. The gas-liquid separator of claim 1 wherein said internal annulus opening is a first internal annulus opening, said gas-liquid separator further comprising a second internal annulus opening beyond said start point of said plate defining a free gas outlet port for said free gas flowpath.

7. The gas-liquid separator of claim 1 further comprising an artificial lift assembly positioned above said plate.

8. The gas-liquid separator of claim 1 further comprising an artificial lift assembly positioned below said plate.

9. The gas-liquid separator of claim 1 wherein said internal tube interior opening comprises a plurality of inlet perforations.

10. The gas-liquid separator of claim 6 wherein said second internal annulus opening comprises a plurality of outlet perforations.

11. The gas-liquid separator of claim 1 wherein said plate is a spiral plate.

12. The gas-liquid separator of claim 11 wherein said spiral plate has at least one turn about said external tube.

13. The gas-liquid separator of claim 1 wherein said plate is a pitched plate.

14. The gas-liquid separator of claim 13 wherein said pitched plate has at least a one-quarter turn about said external tube.

15. The gas-liquid separator of claim 13 wherein said pitched plate is a first pitched plate, said gas-liquid separator further comprising a second pitched plate aligned in parallel or in series with said first pitched plate.

16. A gas-liquid separator positionable down hole in a well bore comprising:

an external tube having an external tube interior;

an internal tube having an internal tube interior defining a reduced-gas fluid flowpath, wherein said internal tube is positioned in said external tube interior to form an internal annulus between said external tube and said internal tube defining a free gas flowpath;

means for spinning a produced fluid mixture about said external tube;

an internal annulus opening through said external tube defining a free gas inlet port for said free gas flowpath, wherein said external tube has a flared portion positioned at or proximal to said internal annulus opening and flaring outwardly as said flared portion extends away from said spinning means; and an internal tube interior opening through said internal tube defining a reduced-gas fluid inlet port for said reduced-gas fluid flowpath.

17. The gas-liquid separator of claim 16 wherein said internal annulus opening is a first internal annulus opening, said gas-liquid separator further comprising a second internal annulus opening through said external tube defining a free gas outlet port for said free gas flowpath, wherein said first and second internal annulus openings are positioned on opposite sides of said spinning means.

18. The gas-liquid separator of claim 16 wherein said spinning means is essentially static relative to said external tube.

19. A method for separating a gas from a produced fluid mixture down hole in a well bore comprising:

positioning a spin-inducing flow channel in a produced fluid flow path of a well bore beneath a production point in a fluid production zone, wherein an external tube with an external tube interior is positioned in said well bore;

producing a produced fluid mixture comprising a gas and a hydrocarbon liquid into said well bore at said production point;

conveying said produced fluid mixture through said produced fluid flow path in a first direction essentially downward away from said production point;

conveying said produced fluid mixture in said first direction through said produced fluid flow path and said spin-inducing flow channel, wherein said spin-inducing flow channel at least partially encircles said external tube to spin said produced fluid mixture about said external tube;

separating a portion of said gas from said hydrocarbon liquid in said produced fluid mixture in response to spinning said produced fluid mixture to produce a separated free gas and a reduced-gas fluid;

conveying said separated free gas through an opening in said external tube into said external tube interior; and conveying said separated free gas through said external tube interior in a second direction essentially upward toward said production point.

20. The gas separation method of claim 19 further comprising positioning an internal tube having an internal tube interior within said external tube interior to form an internal annulus in said external tube interior between said external tube and said internal tube.

21. The gas separation method of claim 20 further comprising conveying said separated free gas upward in said well bore via said internal annulus.

22. The gas separation method of claim 20 further comprising conveying said reduced-gas fluid through an opening in said internal tube into said internal tube interior.

23. The gas separation method of claim 20 further comprising conveying said reduced-gas fluid upward in said well bore via said internal tube interior.

24. The gas separation method of claim 20 wherein said opening in said external tube is a first opening in said external tube, said method further comprising conveying said separated free gas through a second opening in said external tube from said external tube interior.

25. The gas separation method of claim 24 wherein said first opening in said external tube is below said second opening in said external tube.

26. The gas separation method of claim 22 wherein said opening in said external tube is above said opening in said internal tube.

27. The gas separation method of claim 24 wherein said first opening in said external tube is below said production point in said fluid production zone and said second opening in said external tube is above said production point in said fluid production zone.

28. The gas separation method of claim 19 wherein said external tube forms an external annulus between said external tube and a well bore face or casing, said method further comprising conveying said produced fluid mixture from said production point in said fluid production zone through said external annulus to said flow channel.

29. A gas-liquid separator positionable down hole in a well bore comprising:

an external tube having an external tube interior;

an internal tube having an internal tube interior defining a reduced-gas fluid flowpath, wherein said internal tube is positioned in said external tube interior to form an internal annulus between said external tube and said internal tube, said internal annulus defining a free gas flowpath;

a plate having a start point and at least partially encircling said external tube to form a curved flow channel defining a produced fluid mixture flowpath;

an internal annulus opening beyond said start point defining a free gas inlet port for said free gas flowpath, wherein said internal annulus opening comprises a plurality of flared perforations extending through a flared portion of said external tube; and an internal tube interior opening beyond said start point defining a reduced-gas fluid inlet port for said reduced-gas fluid flowpath.

30. A gas-liquid separator positionable down hole in a well bore comprising:

an external tube having an external tube interior;

an internal tube having an internal tube interior defining a reduced-gas fluid flowpath, wherein said internal tube is positioned in said external tube interior to form an internal annulus between said external tube and said internal tube, said internal annulus defining a free gas flowpath;

a plate having a start point and at least partially encircling said external tube to form a curved flow channel defining a produced fluid mixture flowpath;

an internal annulus opening beyond said start point defining a free gas inlet port for said free gas flowpath;

an internal tube interior opening beyond said start point defining a reduced-gas fluid inlet port for said reduced-gas fluid flowpath; and a disk having a plurality of disk perforations extending through said disk, wherein said disk is positioned above said internal-tube interior opening and below said internal annulus opening.

31. A gas-liquid separator positionable down hole in a well-bore comprising:

an external tube having an external tube interior;

an internal tube having an internal tube interior defining a reduced-gas fluid flowpath, wherein said internal tube is positioned in said external tube interior to form an internal annulus between said external tube and said internal tube, said internal annulus defining a free gas flowpath;

a plate having a start point and at least partially encircling said external tube to form a curved flow channel defining a produced fluid mixture flowpath;

an artificial lift assembly positioned below said plate;

an internal annulus opening beyond said start point defining a free gas inlet port for said free gas flowpath; and an internal tube interior opening beyond said start point defining a reduced-gas fluid inlet port for said reduced-gas fluid flowpath.

32. A gas-liquid separator positionable down hole in a well bore comprising:

an external tube having an external tube interior;

an internal tube having an internal tube interior defining a reduced-gas fluid flowpath, wherein said internal tube is positioned in said external tube interior to form an internal annulus between said external tube and said internal tube, said internal annulus defining a free gas flowpath;

a plate having a start point and at least partially encircling said external tube to form a curved flow channel defining a produced fluid mixture flowpath;

an internal annulus opening beyond said start point defining a free gas inlet port for said free gas flowpath; and an internal tube interior opening beyond said start point defining a reduced-gas fluid inlet port for said reduced-gas fluid flowpath, wherein said internal tube interior opening comprises a plurality of inlet perforations.

33. A gas-liquid separator positionable down hole in a well bore comprising:

an external tube having an external tube interior;

an internal tube having an internal tube interior defining a reduced-gas fluid flowpath, wherein said internal tube is positioned in said external tube interior to form an internal annulus between said external tube and said internal tube defining a free gas flowpath;

means for spinning a produced fluid mixture about said external tube;

an internal annulus opening through said external tube defining a free gas inlet port for said free gas flowpath;

an internal tube interior opening beyond said start point defining a reduced-gas fluid inlet port for said reduced-gas fluid flowpath; and a disk having a plurality of disk perforations extending through said disk, wherein said disk is positioned above said internal tube interior opening and below said internal annulus opening.

34. A method for separating a gas from a fluid mixture down hole in a well bore comprising:

producing a fluid mixture comprising a gas and a hydrocarbon liquid from a point in a fluid production zone into a well bore having an external tube with an external tube interior positioned in said well bore;

conveying said fluid mixture through a flow channel at least partially encircling said external tube to spin said fluid mixture about said external tube;

separating a portion of said gas from said hydrocarbon liquid in said fluid mixture in response to spinning said fluid mixture to produce a separated free gas and a reduced-gas fluid;

conveying said separated free gas and said reduce-gas fluid past a flared portion of said external tube flaring outwardly as said flared portion extends away from said flow channel; and conveying said separated free gas through a plurality of perforation flares extending through said flared portion of said external tube into said external tube interior.

35. A method for separating a gas from a fluid mixture down hole in a well bore comprising:

producing a fluid mixture comprising a gas and a hydrocarbon liquid from a point in a fluid production zone into a well bore having an external tube with an external tube interior positioned in said well bore;

conveying said fluid mixture through a flow channel at least partially encircling said external tube to spin said fluid mixture about said external tube;

separating a portion of said gas from said hydrocarbon liquid in said-fluid mixture in response to spinning said fluid mixture to produce a separated free gas and a reduced gas fluid;

conveying said separated free gas through an opening in said external tube into said external tube interior; and conveying said reduced-gas fluid through a disk having a plurality of disk perforations extending through said disk to essentially terminate further spinning of said reduced-gas fluid past said disk, wherein said disk is positioned below said opening in said external tube.

* * * * *